United States Patent [19]

Reinehr et al.

[11] 4,108,845

[45] Aug. 22, 1978

[54] HIGHLY SHRINKABLE ACRYLIC FIBRES OR FILAMENTS

[75] Inventors: Ulrich Reinehr; Alfred Nogaj; Günter Lorenz, all of Dormagen, Fed. Rep. of Germany

[73] Assignee: Bayer Aktiengesellschaft, Leverkusen, Fed. Rep. of Germany

[21] Appl. No.: 653,241

[22] Filed: Jan. 28, 1976

[30] Foreign Application Priority Data

Jan. 31, 1975 [DE] Fed. Rep. of Germany ..... 2504079

[51] Int. Cl.[2] ..... C08F 28/00

[52] U.S. Cl. ..... 526/240; 264/206; 526/329.2; 526/341; 526/342; 526/288; 526/287; 526/312

[58] Field of Search ..... 264/206; 260/79.3 MU; 526/329.2, 341, 342

[56] References Cited

U.S. PATENT DOCUMENTS

| | | | |
|---|---|---|---|
| 3,180,913 | 4/1965 | Veitch et al. | 264/182 |
| 3,330,898 | 7/1967 | Hurley et al. | 264/182 |
| 3,784,666 | 1/1974 | Sekiguchi et al. | 264/182 |
| 3,828,014 | 8/1974 | Wieden et al. | 264/206 |
| 4,011,294 | 3/1977 | Davis | 264/210 F |

*Primary Examiner*—Jay H. Woo

*Attorney, Agent, or Firm*—Plumley and Tyner

[57] ABSTRACT

The invention relates to highly shrinkable fibres or filaments of acrylonitrile polymers or copolymers which have a shrinkability of at least 35% and a fibre strength of at least 2 p/dtex.

The invention relates further to a process for the production of these fibres or filaments.

3 Claims, No Drawings

HIGHLY SHRINKABLE ACRYLIC FIBRES OR FILAMENTS

This invention relates to highly shrinkable acrylic fibres or filaments and to a dry spinning process for their production.

Highly shrinkable dry-spun acrylic fibres having shrinkage levels of around 35% are already known (for example DOS No. 1,435,611). Unfortunately, fibres of this kind have low strength values of the order of 1.5 p/dtex because their high shrinkage values can only be obtained by stretching in water to a maximum of only 250% at stretching temperatures below 90° C. In order to retain their high shrinkability, the fibres also have to be dried and crimped under mild conditions during their production, with the result that, in many cases, they show only a minimal power of adhesion. This often has an extremely adverse effect during further spinning of a yarn, in particular, when these fibres are spun without other fibres being admixed. For example, the assemblage or web of fibres with inadequate strength and adhesion tends to sag in cards, whilst slivers produced therefrom show a similar tendency to sag in the intersecting gill boxes used in worsted spinning. Disturbances and machine stoppages can thereby be caused in both cases. Another critical point in the processing of high-shrinkage fibres occurs in the spinning of yarn from packages. If the packages are unwound irregularly through inadequate fibre adhesion, production can again be brought to a standstill.

An object of the present invention is to provide high-shrinkage fibres having a shrinkage level of 35% and more and with strengths of at least 2 p/dtex, and to obtain adhesion properties sufficient to prevent the disturbances referred to above by taking suitable measures during production of the fibres.

It has now surprisingly been found that, by dividing the stretching process into a prestretching and an after-stretching stage with the high shrinkage level of the acrylic fibres of 35% and more kept intact, it is possible to increase the total stretching ratio to approximately 1:4.5 and, hence, to obtain the required fibre strengths of 2 p/dtex and more.

Accordingly, the present invention relates to highly shrinkable fibres or filaments of an acrylonitrile polymer, which have a fibre strength of at least 2 p/dtex, a shrinkage capacity of at least 35% and good adhesion properties.

In the context of the invention, acrylonitrile polymers are polymers of which at least 50% by weight and preferably at least 85% by weight consist of acrylonitrile and up to 50% by weight of one or more ethylenically unsaturated comonomers.

Suitable comonomers are the usual monomers which can be copolymerised with acrylonitrile, methyl acrylate being particularly preferred. Among the comonomers which improve the dyeability of the filaments, comonomers containing acid groups, more especially (meth)allyl sulphonic acid and its salts preferably its alkali salts and also methacryloyl aminobenzene-benzene disulphonimide or alkali salts thereof are particularly suitable. These comonomers which improve dyeability are preferably copolymerised in a quantity of from 0.1 to 5% by weight.

The invention also relates to a process for the production of a highyl shinkable fibre or filament of a polymer of acrylonitrile which comprises prestretching the dyespun polymer in a ratio of up to 1:3.0 at a temperature of from 60° to 100° C; after-stretching in a ratio of up to 1:2.5 at a temperature of from 60° to 90° C, the total stretching ratio of the two stretching stages carried out in an aqueous medium amounting to at least 1:3.0; crimping the stretched and spun polymer while still wet at a temperature of up to 90° C; and drying at a temperature of up to 70° C.

In the process according to the invention, the prestretching stage is carried out with maximum advantage in an aqueous medium in a ratio of up to 1:3.0 at stretching temperatures of from 75° C up to the boiling temperature. The afterstretching stage can be carried out in a ratio of up to 1:2.5 at stretching temperatures of up to at most 90° C and preferably in the range of from 60° to 75° C. According to the invention, the total stretching ratio of the prestretching and the after-stretching stages carried out in the aqueous medium should amount to at least 3 times the original length of the acrylic fibres in order to obtain the required fibre strength of at least 2 p/dtex. The upper stretching ratios and lower stretching temperatures quoted above represent the limits of the process, beyond which it is not possible, owing to increasing interruptions, to carry out satisfactory, continuous production of highly shrinkable dry-spun acrylic fibres in accordance with the invention.

If conventionally dry-spun acrylic fibres were to be directly stretched in a ratio of 1:4.5 in a single operation at temperatures in the range of from 60 to 90° C, the required strength might indeed be obtained, but in no case would the required shrinkage level of 35% be obtained, as shown in Comparison Example 6.

As already mentioned, one advantage of the process according to the invention is the high strength of the high-shrinkage acrylic fibres or filaments produced in two stages at optionally different stretching temperatures. Fibres of particularly high strength are always obtained in cases where the prestretching stage is carried out at the highest possible temperatures, preferably at boiling temperature, in an aqueous medium, whilst the after-stretching stage is carried out at temperatures of up to at most 90° C and preferably at temperatures in the range of from 60° to 75° C.

By stretching the high-shrinkage fibres in a relatively high stretching ratio with their shrinkage level intact, it is possible not only to obtain fibres of greater strength, but also — by virtue of the relatively high stretching ratio — to obtain fibres of finer denier. This is another significant advantage of the process according to the invention, because, in the conventional dry-spinning process, it is only possible to obtain highly shrinkable acrylic fibres with a shrinkage level of greater than 35% and fine deniers, for example below 3.3 dtex, at low spinning rates on account of the low stretching ratio of at most 250%. By virtue of the process according to the invention, it is readily possible to obtain highly shrinkable acrylic fibres with deniers of as fine as 1.6 dtex.

Another important property of the high-shrinkage fibres obtained by the process according to the invention is their vacuole-free, compact structure. By virtue of this property, finished articles produced from fibres of this kind do not undergo any undesirable changes in colour and gloss for example. In acrylic fibres, vacuole-free structures may be determined, for example, not only by gloss and scattered-light measurements, but also by determining the density of the fibres. Methods for determining fibre density are known and described in the literature, for example H. De Vries and H. G. Wejland: Textile Research Journal 28, No. 2, pages 183 – 184 (1958). It has been found that all the acrylic fibres produced by the new process have a density of about 1.18 g/cc, which indicates the presence of vacuole-free, compact fibre structures.

In another embodiment of the invention, the fibre tows are washed before or after the prestretching stage at temperatures which are best kept below the stretching temperature in order to retain the shrinkage level of the fibres. Washing may of course also be carried out after the second stretching stage. In that case, however, the temperature of the washing bath should not exceed the stretching temperature of the second stretching stage in order to retain the shrinkage level.

The tows are then crimped while still wet, preferably in a stuffer box. It is best to apply an antistatic preparation to the tows before they are crimped. In order to provide the high-shrinkage fibres with the favourable adhesion properties required, the tows are additionally sprayed with steam under a maximum pressure of 1 atm gauge and heated to at most 90° C inside the stuffer box, which provides for stable, intensive crimping. Crimping the wet, prepared and stretched tows in a stuffer box also provides for retention of the high shrinkage level because, when dry tows are crimped, sprayed with steam and heated in a stuffer box, losses are incurred through shrinkage.

For the production of fibres, the tows are subsequently cut into staple fibres and dried at temperatures below 70° C, preferably at a temperature of 40° C. If desired, cutting may also be carried out after the tows have been dried.

The invention is further illustrated but by no way limited by the following Examples, in which the parts and percentages quoted are parts and percentages by weight, unless otherwise stated.

EXAMPLE 1

An acrylonitrile copolymer of 93.6% of acrylonitrile, 5.7% of methyl acrylate and 0.7% of sodium methallyl sulphonate was dry-spun by standard methods known in the art. The tow, which had an overall denier of 1,200,000, was stretched in a ratio of 1:1.5 in boiling water and was subsequently washed under tension in 3 successive washing baths at 80° C (washing baths 1 and 2) and 50° C (washing bath 3). The tow was then after-stretched in a ratio of 1:2.0 at a stretching-bath temperature of 75° C, so that the total stretching ratio amounted to 200%, i.e. to three times the original length of the tow. The rate of travel of the tow after the second stretching stage amounted to 50 m/minute.

Individual filaments removed from the tow showed a shrinkage of 45.0% in boiling water. The tow was then treated with an antistatic preparation and crimped in a stuffer box into which steam was sprayed. The shrinkage of a number of individual filaments removed from the crimp tow was determined and gave an average shrinkage value of 44.6% in boiling water. The tow was then cut into staple fibres, dried in a dryer at 30° to 40° C, baled and packaged. The final denier of each individual fibre amounted to 2.4 dtex. The fibre shrinkage of a number of individual filaments amounted to 43.7% in boiling water. Fibre strength 2.3 p/dtex. Elongation at break 23%. Fibre strength and elongation at break were measured with a Statigraph IV manufactured by the Textechno Company (H. Stein, Monchengladbach, West Germany). The high-shrinkage fibres were then spun into yarn with yarn counts of 40/1. Yarn constants: tensile strength = 11.5 RKm, elongation at break = 12.5%, satisfactory travel over cards and intersecting gill boxes, density = 1.174 g/cc.

EXAMPLE 2

An acrylonitrile copolymer having the same chemical composition as in Example 1 was dry-spun, and the resulting tow with an overall denier of 1,200,000 dtex was washed in boiling water and then stretched to 1.75 times its original length in water at boiling temperature. The tow was then washed at 50° C in three successive washing baths and afterstretched in a ratio of 1:1.87 at 75° C, producing a total stretching ratio of 330%. Individual filaments taken from the tow showed a shrinkage in boiling water of 44.2%. The tow was prepared, crimped, dried at 30° to 40° C and then cut into staple fibres in the same way as described in Example 1. The individual fibres had a final denier of 2.3 dtex. The fibre shrinkage of a number of individual filaments in boiling water amounted to 42.8%. Fibre strength 2.5 p/dtex, elongation at break 18%. The high-shrinkage fibres were spun into yarns with a yarn count of 40/1. Yarn constants: tensile strength 10.5 RKm, elongation at break 12.3% fibre density 1.178 g/cc.

Table I below shows a range of different stretching and temperature conditions, under which fibre shrinkage levels of at least 35% and fibre strengths of at least 2 p/dtex were obtained for acrylic tows with the same chemical composition as in Example 1. The tows were after-treated in the same way as described in Example 1. In each case, the fibre shrinkage levels were repeatedly determined in boiling water on a series of at least 10 individual capillaries.

The invention is by no means limited to the Examples and test conditions quoted. In other words, any particular changes made remain within the scope of the invention.

Table 1

| Test | Prestretching | Stretching temperature | After-stretching | Stretching temperature | Total stretching ratio | Individual fibre denier (dtex) | Fibre strength p/dtex | Fibre shrinkage % |
|---|---|---|---|---|---|---|---|---|
| 1 | 1 : 1.5 | 100° | 1 : 2.25 | 75° | 1 : 3.38 | 3.2 | 2.2 | 46.1 |
| 2 | 1 : 1.5 | 100° | 1 : 2.5 | 75° | 1 : 3.75 | 3.0 | 2.4 | 39.6 |
| 3 | 1 : 1.5 | 100° | 1 : 3.0 | 75° | 1 : 4.5 | 2.5 | 3.4 | 37.9 |
| 4 | 1 : 1.75 | 100° | 1 : 2.0 | 75° | 1 : 3.5 | 3.2 | 2.3 | 43.3 |
| 5 | 1 : 1.75 | 100° | 1 : 2.25 | 75° | 1 : 3.94 | 2.9 | 2.4 | 39.1 |
| 6 | 1 : 2.0 | 100° | 1 : 1.88 | 75° | 1 : 3.76 | 3.0 | 2.5 | 40.2 |
| 7 | 1 : 2.0 | 100° | 1 : 2.05 | 75° | 1 : 4.1 | 2.9 | 2.6 | 39.7 |
| 8 | 1 : 2.25 | 100° | 1 : 1.5 | 75° | 1 : 3.38 | 3.2 | 2.3 | 43.1 |
| 9 | 1 : 2.5 | 100° | 1 : 1.36 | 75° | 1 : 3.4 | 3.2 | 2.1 | 40.7 |
| 10 | 1 : 3.0 | 100° | 1 : 1.5 | 75° | 1 : 4.5 | 2.5 | 3.1 | 36.6 |
| 11 | 1 : 1.75 | 75° | 1 : 1.75 | 75° | 1 : 3.06 | 3.4 | 2.0 | 45.5 |
| 12 | 1 : 1.75 | 75° | 1 : 2.0 | 75° | 1 : 3.5 | 3.2 | 2.3 | 42.5 |
| 13 | 1 : 1.75 | 75° | 1 : 2.25 | 75° | 1 : 3.94 | 2.8 | 2.3 | 36.9 |
| 14 | 1 : 1.75 | 75° | 1 : 2.5 | 75° | 1 : 4.37 | 2.6 | 3.1 | 35.1 |

Table 1-continued

| Test | Prestretching | Stretching temperature | After-stretching | Stretching temperature | Total stretching ratio | Individual fibre denier (dtex) | Fibre strength p/dtex | Fibre shrinkage % |
|---|---|---|---|---|---|---|---|---|
| 15 | 1 : 2.0 | 75° | 1 : 1.75 | 75° | 1 : 3.5 | 3.1 | 2.1 | 43.4 |

As can be seen from Table I, a fibre strength of at least 2 p/dtex and a fibre shrinkage of at least 35% to at most 46% are always obtained for a total stretching ratio of at least 1:3.0.

EXAMPLE 3

An acrylonitrile copolymer of 91.4% of acrylonitrile, 5.2% of methyl acrylate and 3.4% of sodium methallyl sulphonate was dry-spun. The tow with an overall denier of 960,000 dtex was stretched in a ratio of 1:1.5 in boiling water, washed in three successive baths at 70° C and after-stretched in a ratio of 1:2.5 at 75° C, giving a total stretching ratio of 1:3.75. The rate of travel of the tow after the second stretching stage was 50 meters per minute. Individual filaments taken from the tow showed a shrinkage in boiling water of 48.2%. The tow was then treated with an antistatic preparation and crimped in a stuffer box. The crimped tow formed was cut into staple fibres 110 mm long, dried in a dryer at 40° C, baled and packaged. The individual fibres had a final denier of 5.1 dtex. Fibre shrinkage 44.3%, fibre strength 2.4 p/dtex, elongation at break 23%. The high-shrinkage fibres were again spun into yarns with a yarn count of 24/1. Yarn constants: tensile strength 9.9 RKm, elongation at break 11.7%, fibre density 1.176 g/cc.

EXAMPLE 4

An acrylonitrile copolymer of 90.5% of acrylonitrile 5.0% of methyl acrylate and 4.5% of dimethyl aminoethyl methacrylate was dry-spun by standard methods. The tow with an overall denier of 1,040,000 dtex was stretched in a ratio of 1:2.5 in boiling water, washed at 70° C and afterstretched in a ratio of 1:1.3 at 75° C, giving a total stretch of 325%. The rate of travel of the tow after the second stretching stage was 50 meters per minute. Individual filaments taken from the tow showed a shrinkage in boiling water of 43.5%. The tow was prepared, crimped, cut and dried in the same way as in Example 1. Final individual-fibre denier 3.2 dtex, fibre strength 2.5 p/dtex, fibre shrinkage 42.7%, fibre density 1.172 g/cc.

EXAMPLE 5

An acrylonitrile copolymer of 59% of acrylonitrile, 37.5% of vinylidene chloride and 3.5% of sodium methallyl sulphonate was dry-spun. The tow with an overall denier of 945,000 dtex was stretched in a ratio of 1:1.75 in boiling water, washed in three successive baths at 70° C and afterstretched in a ratio of 1:1.87 at 75° C, giving a total stretch of 325%. The tow was then further after-treated and cut into staple fibres 110 mm long in the same way as described in Example 1. The crimped tow underwent 48.5% shrinkage in boiling water, as measured on individual filaments. The individual fibres had a final denier of 3.3 dtex. Fibre strength 2.1 p/dtex, fibre shrinkage 46.9%.

EXAMPLE 6 (Comparison)

An acrylonitrile copolymer with the same chemical composition as in Example 1 was dry-spun and the tows with an overall denier of 1,200,000 dtex were stretched once in various ratios of 75° or at 100° C (cf. Table II). It was then washed in three successive baths at 70° C, treated with an antistatic preparation, crimped and after-treated to form staple fibres in the same way as described in Example 1. The shrinkage in boiling water of the fibres thus obtained was again determined along with fibre strength and fibre density. The fibre densities fluctuate between 1.148 and 1.157 g/cc.

Table II

| Test | Stretching | Stretching tempera-ture | Individual fibre denier (dtex) | Fibre strength p/dtex | Fibre shrinkage (%) |
|---|---|---|---|---|---|
| 1 | 1 : 2.0 | 75° | 3.9 | 1.2 | 45.0 |
| 2 | 1 : 2.5 | 75° | 3.0 | 1.5 | 42.5 |
| 3 | 1 : 3.0 | 75° | 2.5 | 1.7 | 39.0 |
| 4 | 1 : 3.6 | 75° | 2.1 | 1.8 | 34.0 |
| 5 | 1 : 4.0 | 75° | 1.9 | 2.2 | 29.0 |
| 6 | 1 : 2.0 | 100° | 3.6 | 1.4 | 36.5 |
| 7 | 1 : 2.5 | 100° | 2.8 | 1.6 | 31.5 |
| 8 | 1 : 3.0 | 100° | 2.4 | 1.7 | 29.0 |

As can be seen from Table II, the required shrinkage level is obtained at stretching temperatures of 75° C up to a stretching level of 300% (tests 1 to 3). On the other hand, the required strength is not obtained. Conversely, when the required strength is obtained, the necessary shrinkage level is not obtained (test 5). At stretching temperatures of the order of 100° C, the required shrinkage level cannot be obtained for a stretching level of as low as 200%.

EXAMPLE 7 (Comparison)

An acrylonitrile copolymer having the same chemical composition as in Example 3 was stretched in a ratio of 1:2.5 in water at 80° C, washed at 50° C and then further after-treated in the same way as described in Example 1. The fibre shrinkage in boiling water amounted to 41.8%. Fibre strength 1.5 p/dtex. Although the high shrinkage level required was obtained for a stretching level of around 250%, the required strength of at least 2 p/dtex was not obtained.

If, by contrast, the stretching ratio is increased to 1:3.6 at a stretching bath temperature of 75° C, a fibre strength of 2.1 p/dtex is obtained, whereas the fibre shrinkage amounts to only 28%.

We claim:

1. A highly shrinkable dry-spun fiber or filaments of an acrylonitrile polymer which contains at least 50% by weight of acrylonitrile and up to 50% by weight of at least one other ethylenically unsaturated monomer being copolymerizable with acrylonitrile which has a tensile strength of at least 2 p/dtex and a shrinkage capacity in boiling water of at least 35%.

2. The fibre or filament of claim 1, wherein said copolymer contains at least 85% by weight of acrylonitrile.

3. The fibre or filament of claim 1, wherein said other ethylenically unsaturated monomer is a member selected from the group consisting of methyl acrylate, methallyl sulphonic acid or a salt thereof, methacryloyl aminobenzene-benzene disulphonamide or a salt thereof and a mixture thereof.

* * * * *